US005511587A

United States Patent [19]

Miya et al.

[11] Patent Number: 5,511,587

[45] Date of Patent: Apr. 30, 1996

[54] WEAR-RESISTANT REED FOR A HIGH-SPEED LOOM

[75] Inventors: Yukio Miya, Kawagoe; Shigeru Kizaki, Hanno; Osamu Sugiyama, Fuchu; Akiteru Hatayama, Kawagoe; Yoshitsugu Shibuya, Toda; Mitsugu Enomoto, Higashikurume; Koichi Naoi, Sayama; Yuji Fukazawa, Tokyo; Takanori Nanya, Sayama; Shotaro Shimizu, Kunitachi; Hiroshi Tagawa, Kashiwa, all of Japan

[73] Assignee: Citizen Watch Co., Ltd., Japan

[21] Appl. No.: 426,462

[22] Filed: Apr. 19, 1995

Related U.S. Application Data

[63] Continuation of Ser. No. 30,029, Aug. 30, 1993, abandoned.

[30] Foreign Application Priority Data

| | | | |
|---|---|---|---|
| Sep. 28, 1990 | [JP] | Japan | 2-101865 U |
| Nov. 16, 1990 | [JP] | Japan | 2-119338 U |

[51] Int. Cl.[6] ..... D03D 49/62

[52] U.S. Cl. ..... 139/192; 428/216

[58] Field of Search ..... 428/469, 364, 428/216; 139/192

[56] References Cited

U.S. PATENT DOCUMENTS

| | | | |
|---|---|---|---|
| 4,822,662 | 4/1989 | Ishii et al. | 428/469 |
| 4,848,410 | 7/1989 | Linka et al. | 139/134 |
| 4,902,535 | 2/1990 | Garg et al. | 427/292 |
| 5,190,807 | 3/1993 | Kimock et al. | 428/216 |
| 5,288,543 | 2/1994 | Ueda et al. | 428/216 |

FOREIGN PATENT DOCUMENTS

| | | | |
|---|---|---|---|
| 61-091354 | 9/1986 | Japan . | |
| 1201054 | 9/1986 | Japan | 139/192 |
| 2199851 | 8/1987 | Japan | 139/192 |
| 3270843 | 11/1988 | Japan | 139/192 |
| 1132779 | 5/1989 | Japan . | |
| 2100969 | 4/1990 | Japan . | |
| 5033244 | 2/1993 | Japan | 139/192 |

*Primary Examiner*—Andy Falik
*Attorney, Agent, or Firm*—Howell & Haferkamp

[57] ABSTRACT

A diamond-like carbon (DLC) film is formed on a portion of a reed blade in a high-speed loom which requires the highest wear resistance. When a stainless steel is used as the base material of the reed blade, the DLC film is formed through an intermediate layer comprising, e.g., a titanium carbide layer. Reed blades coated with a DLC film are arranged at the side portions of the reed where wear progresses quickly, while reed blades coated with hard films requiring a relatively low cost, or non-coated reed blades, are arranged in the central portion of the reed, thereby uniforming the blade wear throughout the entire reed. The reed is suitable to many types of fibers, ranging from natural to synthetic and new material fibers.

19 Claims, 3 Drawing Sheets

WEAR-RESISTANT REED FOR A HIGH-SPEED LOOM

This is a continuation of application Ser. No. 08/030,029, filed on Aug. 30, 1993, abandoned.

BACKGROUND OF THE INVENTION

The present invention relates to a reed for a high-speed loom and, more particularly, to a reed for a high-speed loom which has reed blades coated with a hard film in order to increase their resistance to wear.

A reed is a component of a loom used to align and press the warps and wefts, respectively, of the loom, thereby straightening the weave pattern. The reed is formed by arranging a large number of reed blades, each comprising a thin metal plate, parallel to each other at small gaps, and attaching the blades to a frame having right and left side master blades and upper and lower metal portions. In a high-speed loom, reed blades made of stainless steel are generally used. However, due to increases in the operating speeds of looms and the introduction of new material fibers, wear of the reed blades has become severe. Increasing the wear resistance of reed blades poses an important problem.

More specifically, wear of the reed blades causes raising of the woven fabric and end breakage. Because replacement of the reed requires a large amount of labor and cost, the durability of the reed blades is the most significant factor that determines the operating efficiency and cost of the loom. In a woven fabric, since the width of the woven fabric becomes smaller than the total width of the arranged warps to cause a phenomenon called "crimp", an especially large frictional force acts on the reed blades arranged in the vicinities of the two sides of the reed. Hence, the durability of these portions determines the service life of the entire reed.

Therefore, in order to improve the durability of the reed, it is proposed to coat the surfaces of the reed blades, especially in the vicinities of the two sides of the reed, with a hard film which has an excellent wear resistance, e.g., a hard chrome plating film, a ceramic film (Japanese Patent Laid-Open No. 60-52658) made of tungsten carbide, titanium carbide, titanium nitride or the like, or a chrome oxide film (Japanese Patent Laid-Open No. 61-245346, and U.S. Pat. No. 4,822,662).

A hard chrome plating film is formed by electroplating. However, the hard chrome plating film has poor wear resistance as well as poor adhesive properties and corrosion resistance. A ceramic film is formed in accordance with Physical Vapor Deposition (PVD), Chemical Vapor Deposition (CVD), flame spraying, or the like. However, the ceramic film has poor adhesive properties and causes softening of the base material upon high temperature treatment. A chrome oxide film is formed thermochemically and is effective when formed on reed blades for use with polyester fibers. However, the chrome oxide film is not sufficiently effective when formed on reed blades for use with natural or new material fibers.

Wear of the reed blades is a phenomenon in which the types of fibers, frictional force, vibration characteristics of the reed, and the like are closely related to each other in a complex manner. It is known that a hard film having a high surface hardness does not always provide a good effect. Accordingly, although a hard film matched with the types of fibers, the operating speed of the loom, and other conditions is employed, it provides an improvement in durability of only about two to five times that of a stainless steel base material not coated with a hard film.

SUMMARY OF THE INVENTION

It is, therefore, an object of the present invention to provide a reed blade suitable for use with many types of fibers, ranging from natural to synthetic and new material fibers, and having a remarkably improved durability at a relatively low cost.

In order to achieve the above object, according to the present invention, a Diamond-Like Carbon (DLC) film is formed on a portion of a reed blade requiring the highest wear resistance. When a stainless steel is used as the base material of the reed blade, an intermediate layer comprising, e.g., a titanium carbide layer is interposed between the base material and the DLC film to improve the adhesive properties. Furthermore, reed blades coated with a DLC film are arranged in the vicinities of the two sides of the reed where wear progresses most quickly, while reed blades coated with a hard film requiring a relatively low cost, or non-coated reed blades, are arranged in the central portion of the reed, thereby uniforming the blade wear throughout the entire reed. As a result, an improvement in total durability is realized at a relatively low cost.

The DLC film employed in the present invention is a hydrogen-coupled amorphous carbon film and is introduced in, e.g., L. P. Anderson, *A Review of Recent Work On Hard i-C Films, Thin Solid Films*, 86 (1981), pp. 193–200.

An example of a method of forming a DLC film is plasma CVD in a hydrocarbon gas atmosphere. A DLC film exhibits a hardness like diamond, a thermal conductivity about five times that of copper, and a very small coefficient of friction. These characteristics have been utilized in the slidable surfaces of mechanical components and the like. Moreover, since the large tensile strength and small internal friction of DLC films realize vibration characteristics suitable for acoustic appliances, DLC films have also been formed on the diaphragms of loudspeakers and the like. Not much is known regarding the behavior of DLC films on the high-wear portions of reed blades driven at high speeds. However, the large surface hardness, small coefficient of friction, thermal conductivity, and vibration characteristics are assumed to contribute to an improvement in the durability of the reed blades.

DESCRIPTION OF THE PREFERRED EMBODIMENTS

The preferred embodiments of the present invention will be described with reference to the accompanying drawings.

Figure 1:
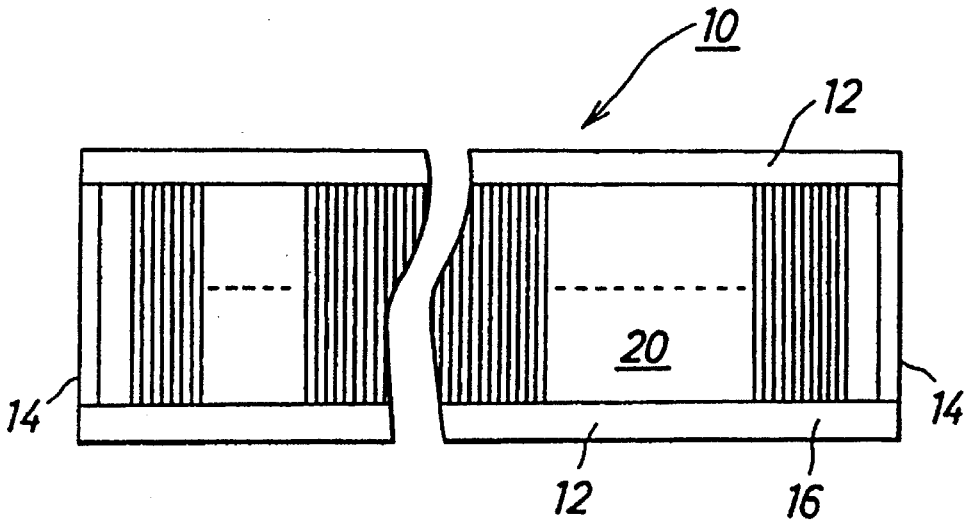
FIG. 1 is a front view of a reed.

As shown in FIG. 1, a reed 10 holds a large number of reed blades 20 at predetermined gaps with a frame 16 constituted by upper and lower metal portions 12 and right and left side master blades 14. The reed blades 20 comprise thin metal plates and have a shape as shown in FIG. 2 or 3.

Figure 2:
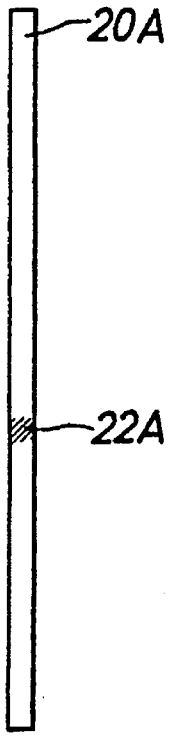
FIG. 2 is a plan view of a flat reed blade.
Figure 3:
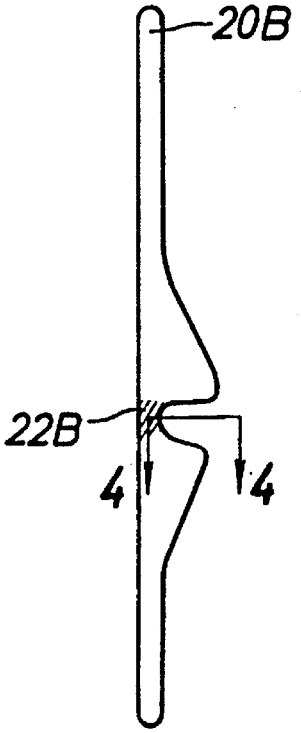
FIG. 3 is a plan view of a modified reed blade.

The reed blade 20A shown in FIG. 2 is called a flat reed blade. The reed blade 20B shown in FIG. 3 is called a profiled reed blade and is used in water jet or air jet looms. For either reed blade, a hatched portion 22A or 22B shown in FIG. 2 or 3, i.e., the central portion of the reed blade, is the maximum wear portion. In the reed blade of the present invention, at least this portion is coated with a DLC film.

A stainless steel is generally used as the base material of the reed blade. However, when a DLC film is directly formed on the surface of the stainless steel, sufficiently high adhesive properties cannot be obtained, and the object of the present invention cannot be attained.

Therefore, according to the present invention, an intermediate film is interposed between the stainless steel base material and the DLC film to improve the adhesive properties. As the intermediate layer, a two-layered film having a chromium (Cr) or titanium (Ti) lower layer exhibiting good adhesive properties with the stainless steel and a silicon (Si) upper layer exhibiting good adhesive properties with the DLC film is effective. Single layered carbide films of, e.g., titanium (Ti), zirconium (Zr), and hafnium (Hf) exhibiting good adhesive properties with both the stainless steel and the DLC film are also effective as the intermediate layer. A titanium carbide film (Japanese Patent Laid-Open No. 64-79372) containing an excessive amount of carbon is most effective.

Figure 4:
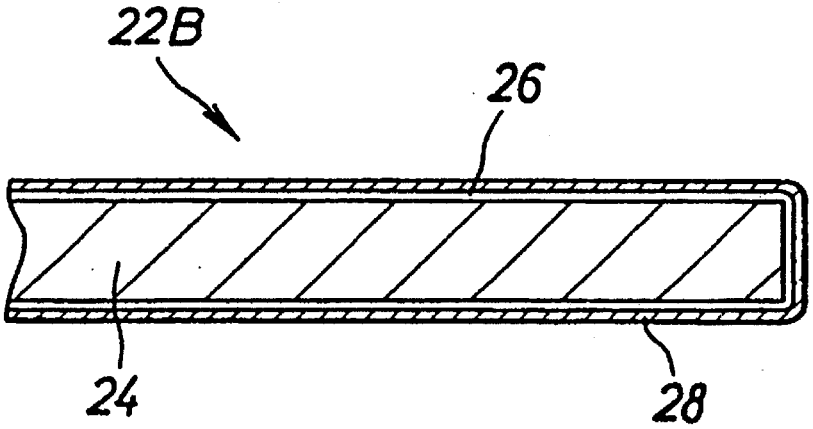
FIG. 4 is a partial sectional view of the reed blade of FIG. 3 made according to the present invention.

FIG. 4 is a partial sectional view of the maximum wear portion 22B of the reed blade 20B shown in FIG. 3. A titanium carbide film is formed as an intermediate layer 26 on the surface of a base material 24 made of a stainless steel, and a DLC film 28 is formed on the surface of the intermediate layer 26. The titanium carbide film can be formed in accordance with plasma CVD in a vacuum chamber in which a hydrocarbon gas is introduced.

Figure 6:
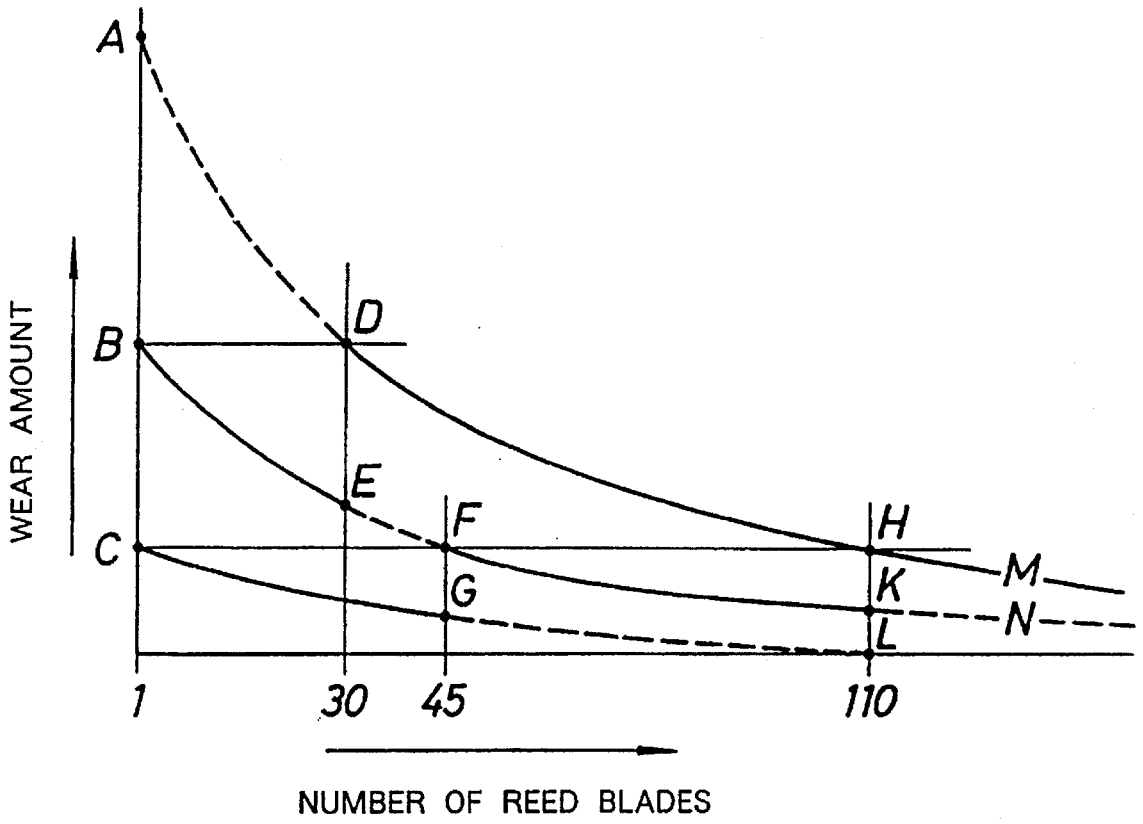
FIG. 6 is a graph showing the relationship between the reed blade position and the amount of wear.

FIG. 6 is a graph schematically showing the relationship between the position and wear amount of the reed blades under average operating conditions of a high-speed loom for three types of reed blades. The axis of abscissa represents the position of a reed blade by way of the number of reed blades counted from a side portion of the reed. A curve ADHM indicates the wear amount of reed blades made of a non-coated stainless steel base material, a curve BEFKN indicates the wear amount of reed blades coated with hard chrome plating films, and a curve CGL indicates the wear amount of reed blades coated with DLC films according to the present invention.

The service life of the reed is determined by the wear of the outermost (1st) reed blades which are worn most, as described above. However, when the hard chrome plating films are formed on the reed blades made of the stainless steel base material, the wear amount of the outermost reed blades is decreased to half from A to B. Since this wear amount B corresponds to a wear amount D of the non-coated 30th reed blades, the wear amount of the entire reed can be decreased to a level of B or less by coating the 1st to 30th reed blades with hard chrome plating films. However, even if plating films are formed on the internal reed blades following the 30th reed blades, the service life of the entire reed is not prolonged.

In contrast, when DLC films are formed on the reed blades according to the present invention, the wear amount of the outermost reed blades is greatly decreased from A to C. This wear amount C corresponds to a wear amount H of the non-coated 110th reed blades. Therefore, in order to obtain a sufficiently wear-resistant reed by forming DLC films, at least the 1st thru 110th reed blades must be coated with the DLC films.

To form a DLC film requires a relatively high cost. However, since the DLC film improves the durability of the reed remarkably, it has a sufficiently high practicality, depending on the weaving conditions. To combine a DLC film with other hard films is also a very effective means. As shown in FIG. 6, the wear amount C of the outermost reed blades coated with the DLC films corresponds to a wear amount F of the 45th reed blades coated with hard chrome plating films. Therefore, when DLC films are formed on the 1st to 45th reed blades and hard chrome plating films are formed on the 46th to 110th reed blades, the same practical effect as that obtained when DLC films are formed on all the reed blades can be obtained. In this manner, when a plurality of hard films having different coating costs and wear resistances are combined to uniform the blade wear throughout the entire reed, the durability of the reed can be remarkably improved at a relatively low cost.

Figure 5:
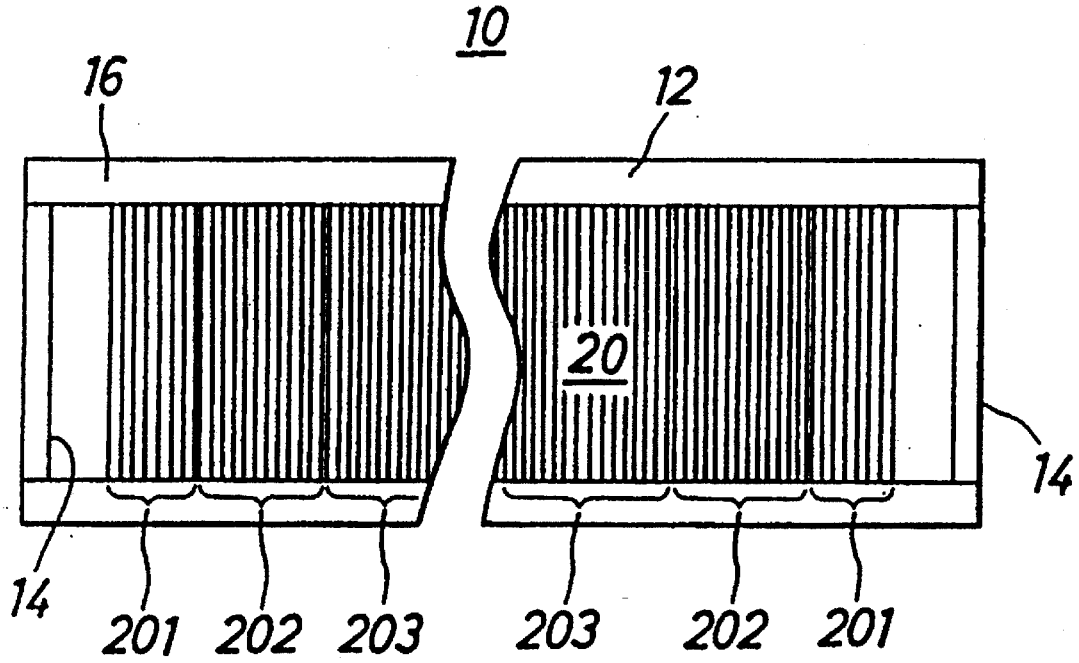
FIG. 5 is a partially cutaway front view of the reed of the present invention.

FIG. 5 is a front view of a reed showing the arranged state of reed blades according to the present invention. Reed blades 20 are divided into first, second, and third groups 201, 202, and 203 from the group of blades adjacent to master blades 14 on each side of the reed. Each first group 201 is a group of reed blades having a DLC film formed on the surface of a stainless steel base material through an intermediate layer, each second group 202 is a group of reed blades having a hard film different from the DLC film formed on the surface of a stainless steel base material, and each third group 203 is a group of reed blades made from a non-coated stainless steel base material.

Various types of fibers were woven into fabrics by using a reed according to the present invention having a plurality of reed blades grouped in this manner, a reed according to the present invention in which only DLC films were formed on the reed blades, a reed of the prior art in which hard films other than DLC were formed on the reed blades, and a general reed in which the reed blades are made only of a stainless steel base material. The durabilities of the reeds were studied. Tables 1, 2 and 3 show the obtained results.

TABLE 1

Fiber: Cotton Yarn

| | Side Portions–Central Portion | | | Operating Time | Ratio of Durability | Cost |
|---|---|---|---|---|---|---|
| Comparative Example 1 | Stainless steel (SS) base material 100% | | | 12 hr | 1.0 | 1.0 |
| Comparative Example 2 | Chrome plating 10% | SS base material 90% | | 36 hr | 2.2 | 1.1 |
| Comparative Example 3 | $Cr_2O_3$ 20% | | SS base material 80% | 36 hr | 3.0 | 1.8 |

TABLE 1-continued

| Fiber: Cotton Yarn | | | | | | | |
|---|---|---|---|---|---|---|---|
| | Side Portions–Central Portion | | | | Operating Time | Ratio of Durability | Cost |
| Example 1 | DLC film 40% | | | SS base material 60% | 80 hr | 6.7 | 4.7 |
| Example 2 | DLC film 10% | $Cr_2O_3$ 10% | Chrome 20% | SS base material 60% | 80 hr | 6.7 | 2.5 |

Table 1 shows the result of a durability test wherein standard weaving was performed by a high-speed loom using a cotton yarn as the fiber. As shown in Comparative Example 1, when weaving was executed under fixed conditions using a conventional reed made of only the stainless steel base material, defects such as end breakage and raising of the woven fabric occurred after an operation of about twelve hours. The ratios of durability were calculated by using the operating time of Comparative Example 1 as the reference. Hence, the ratio of durability for Comparative Example 1 is 1.0.

As shown in Comparative Example 2, in the conventional reed in which hard chrome plating films are formed on 10% of all the reed blades (5% per side), the durability is increased twice or more. As shown in Comparative Example 3, in a conventional reed in which chrome oxide ($Cr_2O_3$) films are formed on 20% of all the reed blades, the durability is increased about three times or more.

In contrast, as shown in Example 1, in the reed of the present invention in which DLC films are formed on 40% of all the reed blades, the durability is increased to about seven times. Although the cost of the reed is increased to about five times that of Comparative Example 1, when the quality of the woven fabric and the operating efficiency of the loom are considered, the cost of the reed can be justified.

In Example 2, three groups of reed blades made of a stainless steel are arranged in a reed. In the first group, DLC films are formed on 10% of all the reed blades upon which the largest frictional force acts. In the second group, reed blades coated with chrome oxide films and hard chrome plating films are arranged. In the third group, corresponding to 60% of the reed blades and the central portion of the reed, reed blades made of a non-coated stainless steel base material are arranged. In this reed, a durability similar to that of Example 1 can be obtained with the cost decreased in half. In this manner, the blade wear throughout the whole reed is made uniform by adopting a plurality of hard films at a cost less than the reed of Example 1.

It is known that when modified polyester fibers having complex sectional shapes are to be woven into a fabric, wear of reed blades made only of a stainless steel base material is severe, and the operating efficiency of the loom is considerably low. Table 2 shows examples of operating times and durabilities for various reeds used in the weaving of modified polyester fibers. As shown in Comparative Example 4, wear of reed blades made from a non-coated stainless steel base material is severe, and the operating time is decreased to about 30% of that obtained when weaving was performed with cotton yarn. Hence, as shown in Comparative Example 5, using hard chrome plating films on the reed blades in the vicinities of the side portions of the reed increases the operating time substantially.

In contrast, as shown in Example 3, in a reed in which DLC films are formed on 70% of all the reed blades, the durability is remarkably improved. Furthermore, as shown in Example 4, when DLC films and hard chrome plating films are used together with non-coated reed blades, the cost can be decreased from that of Example 3 with little, if any, decrease in the durability.

TABLE 2

| Fiber: Modified Polyester | | | | | | |
|---|---|---|---|---|---|---|
| | Side Portions–Central Portion | | | Operating Time | Ratio of Durability | Cost |
| Comparative Example 4 | Stainless Steel (SS) 100% | | | 4 | 1.0 | 1.0 |
| Comparative Example 5 | Chrome plating 30% | SS base material 70% | | 22 | 5.5 | 1.3 |
| Example 3 | DLC film 70% | | SS base material 30% | 42 | 10.5 | 7.3 |
| Example 4 | DLC film 40% | Chrome plating 30% | SS base material 30% | 40 | 10.0 | 4.9 |

TABLE 3

| | Fiber: New Material | | | | |
|---|---|---|---|---|---|
| | Side Portions–Central Portion | | Operating Time | Ratio of Durability | Cost |
| Comparative Example 6 | Stainless steel (SS) 100% | | 0.33 | 1.0 | 1.0 |
| Comparative Example 7 | Titanium nitride (TiN) film 100% | | 2.5 | 7.6 | 5.0 |
| Example 5 | DLC film 100% | | 8.0 | 24.0 | 10.0 |
| Example 6 | DLC film 30% | Titanium nitride film 70% | 8.0 | 24.0 | 6.5 |

A specially-sized fiber on which a fine ceramic powder is applied is attracting attention as a functional new material fabric. As shown in Comparative Example 6, when such a new material fiber is woven into a fabric using conventional stainless steel reed blades, a defect occurs within a very short period of time, and thus a practical operation using this fiber is impossible. Hence, as shown in Comparative Example 7, a reed in which titanium nitride (TiN) films, known as ultra-hard films, are formed on all the reed blades was used. In this case, however, the wear amount of the reed blades is still large enough to cause a defect within two to three hours. Therefore, the operability is poor, and the operating efficiency of the loom is very low.

In contrast, as shown in Example 5, when a reed in which DLC films are formed on all the reed blades is used, a continuous operation of eight hours is possible, and no problem occurs in the weaving operability. In addition, when reed blades coated with DLC films are arranged in the vicinities of the two side portions of the reed and reed blades coated with titanium nitride films are arranged at the central portion of the reed, a similar effect to that of Example 5 can be obtained while decreasing the cost.

As described above, according to the present invention, the following specific effects can be obtained:

(1) The reed of the present invention is suitable to various types of fibers, ranging from natural to synthetic and new material fibers, and exhibits an excellent durability.

(2) Since a sufficient effect can be obtained with a DLC film having a thickness of two to three microns, including the intermediate layer, the DLC film can be applied to a reed having a small blade pitch.

(3) When the quality of the fabric and the operating efficiency of the loom are considered, a decrease in total cost is enabled.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A reed for a high-speed loom, in which a large number of reed blades comprising thin metal plates are arranged parallel to each other at predetermined gaps and are fixed and held with a frame comprising right and left side master blades and upper and lower side metal portions, a plurality of reed blades adjacent to said master blades forming a first group and a plurality of reed blades adjacent to said first group forming a second group characterized in that said reed blades of said first group including a maximum wear portion are coated with DLC films, and said reed blades of said second group are coated with hard films of a different type than said DLC films.

2. A reed for a high-speed loom according to claim 1, characterized in that said reed blades are made of a stainless steel, and said DLC film is formed through an intermediate layer of said reed blades.

3. A reed for a high-speed loom according to claim 2, characterized in that said intermediate layer comprises a titanium carbide layer.

4. A reed for a high-speed loom according to claim 1, characterized in that said reed blades of said second group are further divided into a plurality of groups, and reed blades of the divided groups are coated with different types of hard films, respectively.

5. A reed for a high-speed loom according to claim 4 characterized in that said different types of hard films are selected from the group consisting of hard compound films of an oxide, a carbide, nitride, or hard chrome plating films.

6. A reed for a high-speed loom according to claim 1, characterized in that reed blades of a third group which are made of only a stainless steel are arranged adjacent to said reed blades of said second group.

7. A reed for a high-speed loom according to claim 6 characterized in that said different types of hard films are selected from the group consisting of hard compound films of an oxide, a carbide, nitride, or hard chrome plating films.

8. A reed for a high-speed loom according to claim 1 characterized in that said different types of hard films are selected from the group consisting of hard compound films of an oxide, a carbide, nitride, or hard chrome plating films.

9. A reed for a high speed loom, said reed having a plurality of reed blades arranged substantially parallel to each other in a single file with two outer groups and a middle group wherein some of said reed blades are subjected to greater wear during use than others of said reed blades, only said greater wear reed blades having a DLC film thereon, and said middle group having a hard film thereon comprised of a material other than DLC.

10. The reed of claim 8 wherein said reed blades having the DLC film thereon are in the outer groups.

11. The reed of claim 10 wherein a portion of each of the reed blades comprising at least the two outer groups is subjected to greater wear than other portions of each of said reed blades and the DLC film covers at least said greater wear portions.

12. The reed of claim 11 wherein said middle group is itself comprised of a plurality of divided groups of reed blades and the reed blades of each divided group has a different hard film thereon from the reed blades of the other divided groups.

13. The reed of claim 9 wherein each of said DLC film reed blades further comprises an intermediate film joining said DLC film to said reed blade.

14. The reed of claim 13 wherein said reed blades having the DLC film thereon are in the outer groups.

15. The reed of claim 14 wherein a portion of each of the reed blades comprising at least the two outer groups is subjected to greater wear than other portions of each of said reed blades and the DLC film covers at least said greater wear portions.

16. The reed of claim 15 wherein said intermediate film is a titanium carbide film.

17. A reed for a high speed loom, said reed having a plurality of reed blades arranged in single file and substantially parallel to each other, said reed blades comprising two outer groups surrounding a middle group, each of said reed blades in said outer groups having a portion which receives heavier wear during use than other portions thereof, and a DLC film covering only said heavier wear portions to thereby increase the useful life of said reed, others of said reed blades in said middle group not having the DLC covering.

18. A reed for a high speed loom, said reed having a plurality of reed blades arranged substantially parallel to each other at predetermined intervals and each reed blade having a thin metal plate with a stainless steel base metal, said reed blades being secured to a frame having right and left side master blades and upper and lower side metal portions, said reed including a plurality of reed blades adjacent said master blades forming a pair of outside reed blade groups and a plurality of reed blades adjacent each of said pair of outside reed blade groups forming a pair of inside reed blade groups, each blade of said outside pair of reed blade groups being coated with a DLC film on at least a portion including a maximum wear portion thereof and each blade of said inside reed blade groups having no DLC film thereon such that a wear amount of an outermost reed blade of said outside reed blade groups substantially corresponds to a wear amount of an outermost reed blade of said inside reed blade groups.

19. A reed for a high speed loom according to claim 18 characterized in that said DLC films are formed through intermediate layers of said outside pair of reed blade groups.

* * * * *